US005607061A

United States Patent [19]

Felden

[11] Patent Number: 5,607,061

[45] Date of Patent: Mar. 4, 1997

[54] MATERIAL SEPARATOR SYSTEM UTILIZING AIR FLOW

[76] Inventor: Richard W. Felden, P.O. Box 980243, West Sacramento, Calif. 95798

[21] Appl. No.: 405,802

[22] Filed: Mar. 16, 1995

[51] Int. Cl.[6] ..... B07B 4/00

[52] U.S. Cl. ..... 209/139.1; 209/142

[58] Field of Search ..... 209/139.1, 138, 209/142, 149, 154, 910, 920, 244, 245, 911

[56] References Cited

U.S. PATENT DOCUMENTS

| | | | |
|---|---|---|---|
| 2,711,247 | 6/1955 | Hills | 209/139.1 X |
| 4,252,240 | 2/1981 | Satake | 209/920 X |

FOREIGN PATENT DOCUMENTS

| | | | |
|---|---|---|---|
| 1284604 | 1/1987 | U.S.S.R. | 209/139.1 |

*Primary Examiner*—David H. Bollinger
*Attorney, Agent, or Firm*—Thomas R. Lampe

[57] ABSTRACT

A system for sorting seeds or other discrete objects in which the discrete objects are successively passed through adjacent vertical chambers. Upwardly directed air flows are created in the chambers directing some of the discrete objects to exit openings. Discrete objects not passing through the exit opening leading from a chamber will be directed to an adjacent chamber by a tilted screen leading to a passageway between the adjacent chambers. The air flows within the chambers are separately controlled.

16 Claims, 5 Drawing Sheets

MATERIAL SEPARATOR SYSTEM UTILIZING AIR FLOW

TECHNICAL FIELD

This invention relates to a system for sorting a plurality of discrete objects and separating the discrete objects into separate groups based on at least one physical characteristic of the discrete objects. The invention encompasses both an apparatus and a method, and is applicable, for example, to the sorting of seeds. It is also appropriate for use in connection with related activities such as cleaning seeds or other discrete objects.

BACKGROUND ART

A number of devices have been utilized in the past to divide a plurality of discrete objects such as seeds into separate groups based on one or more physical characteristics of the discrete objects. A principal mechanism employed to process and separate seeds into groups is the vibrating table separator which supports seeds and separates and generally classifies the seeds according to size and/or density. Such arrangements are relatively inefficient and expensive and do not provide the degree of reliability one would desire, particularly when processing relatively small and light objects such as seeds. Furthermore, adjustment of such prior art mechanisms to process different types of seeds or other discrete objects is difficult if not impossible.

As will be described in detail below, the present invention utilizes a plurality of chambers to separate seeds or other discrete objects, gaseous flows within the chambers being utilized to accomplish such result. The gaseous flows in the plurality of chambers are separately and independently controlled to provide for highly effective separation and classification of seeds or other discrete objects. While the prior art generally teaches the concept of entraining discrete objects in gaseous flows for separation and other purposes, the inventor is not aware of the existence of prior art systems which have utilized a plurality of independently variable gaseous flows to sort and separate discrete objects such as seeds into separate groups, as disclosed and claimed herein.

DISCLOSURE OF INVENTION

The present invention is for sorting a plurality of discrete objects and separating the discrete objects into separate groups based on one or more physical characteristics of the discrete objects.

The apparatus includes chamber defining means including chamber walls defining a plurality of separate vertically oriented chambers, a first chamber of the plurality of chambers initially receiving discrete objects from a source thereof and the other chambers of said plurality of chambers serially receiving discrete objects after passage thereof through the first chamber. The chamber walls define passageways between adjacent chambers of the plurality of chambers and exit openings spaced upwardly from the passageways communicating with the chambers.

Gaseous flow inducing means is operatively associated with the chamber defining means for creating upwardly directed gaseous flows in the plurality of chambers to entrain discrete objects located therein, cause upward movement of the discrete objects toward the exit openings, and exit of discrete objects from the chambers through the exit openings.

The apparatus also includes control means for separately and independently controlling the velocity of the upwardly directed gaseous flow in each chamber of the plurality of chambers.

Conveying means is incorporated in the apparatus for conveying discrete objects not exiting from a chamber through an exit opening due to entrainment by the gaseous flow therein through a passageway to an adjacent chamber and into the gaseous flow of the adjacent chamber.

The invention also encompasses a method of sorting a plurality of discrete objects and separating the discrete objects into separate groups based on one or more physical characteristics of the discrete objects.

The method includes the step of introducing discrete objects into a first chamber having a first passageway and a first exit opening spaced upwardly from the first passageway.

A first upwardly directed gaseous flow is directed into the first chamber. Discrete objects in the first chamber are entrained in the first upwardly directed gaseous flow.

At least some of the first gaseous flow is passed through the first exit opening along with discrete objects entrained thereby. The discrete objects which did not pass through the first exit opening are moved through the first passageway into a second chamber having a second passageway and a second exit opening spaced upwardly from the second passageway.

A second upwardly directed gaseous flow is directed into the second chamber and entrains discrete objects which moved through the first passageway into the second chamber.

At least some of the second gaseous flow is passed through the second exit opening along with discrete objects entrained thereby. The discrete objects which did not pass through the second exit opening are moved through the second passageway.

Other features, advantages, and objects of the present invention will become apparent with reference to the following description and accompanying drawings.

BEST MODE FOR CARRYING OUT THE INVENTION

Figure 1:
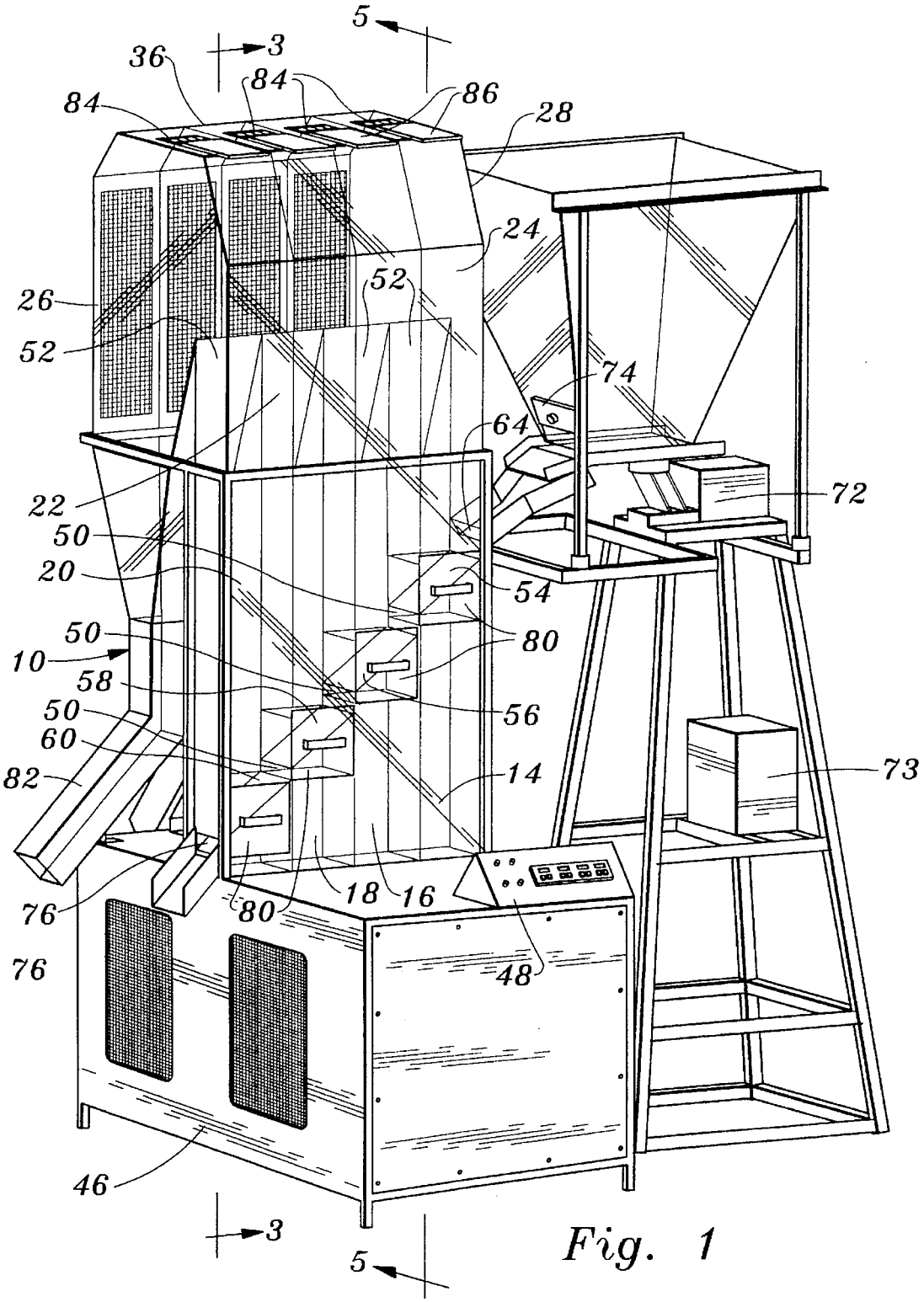
FIG. 1 is a front perspective view of apparatus constructed in accordance with the teachings of the present invention.
Figure 2:
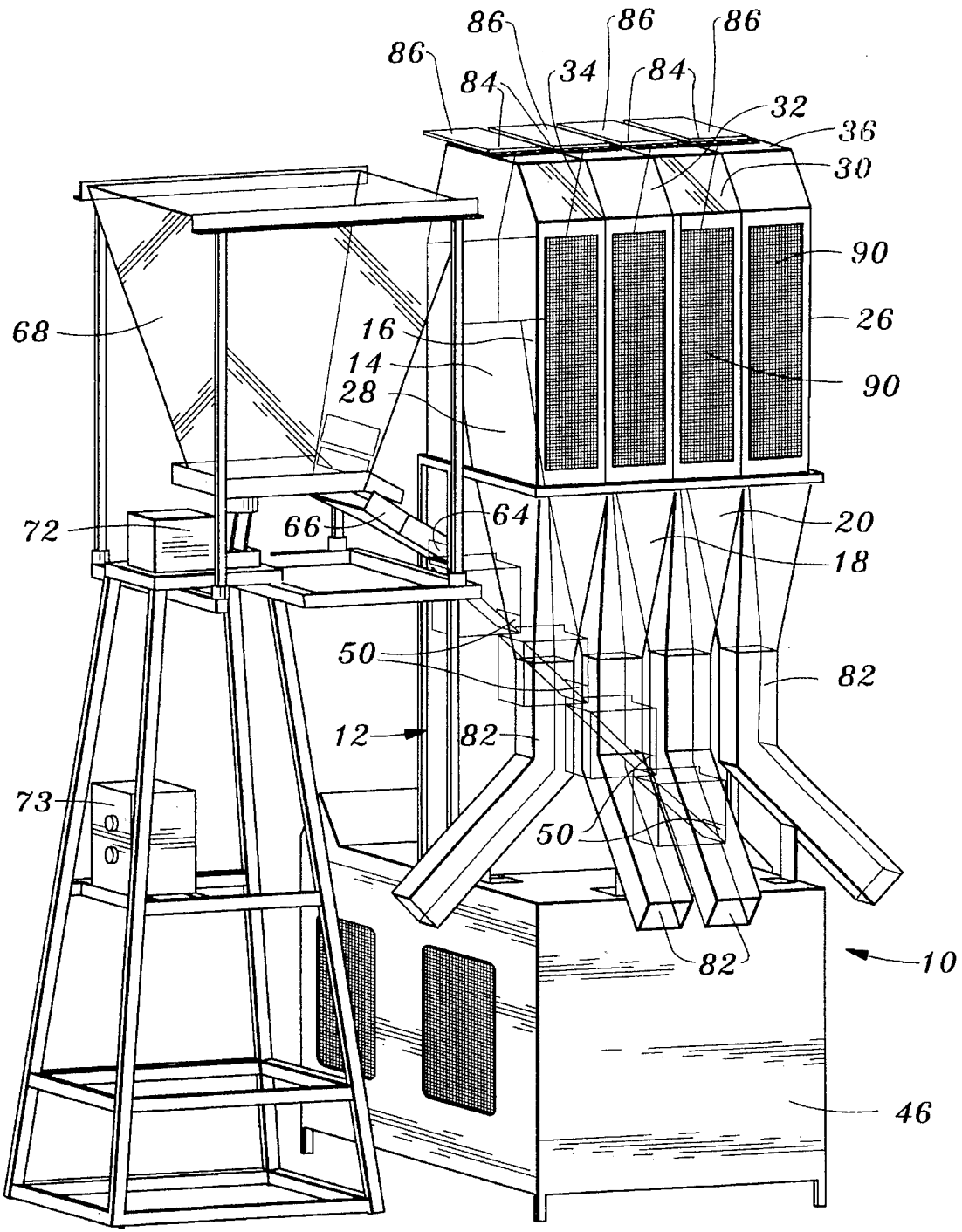
FIG. 2 is a rear perspective view of the apparatus.
Figure 4:
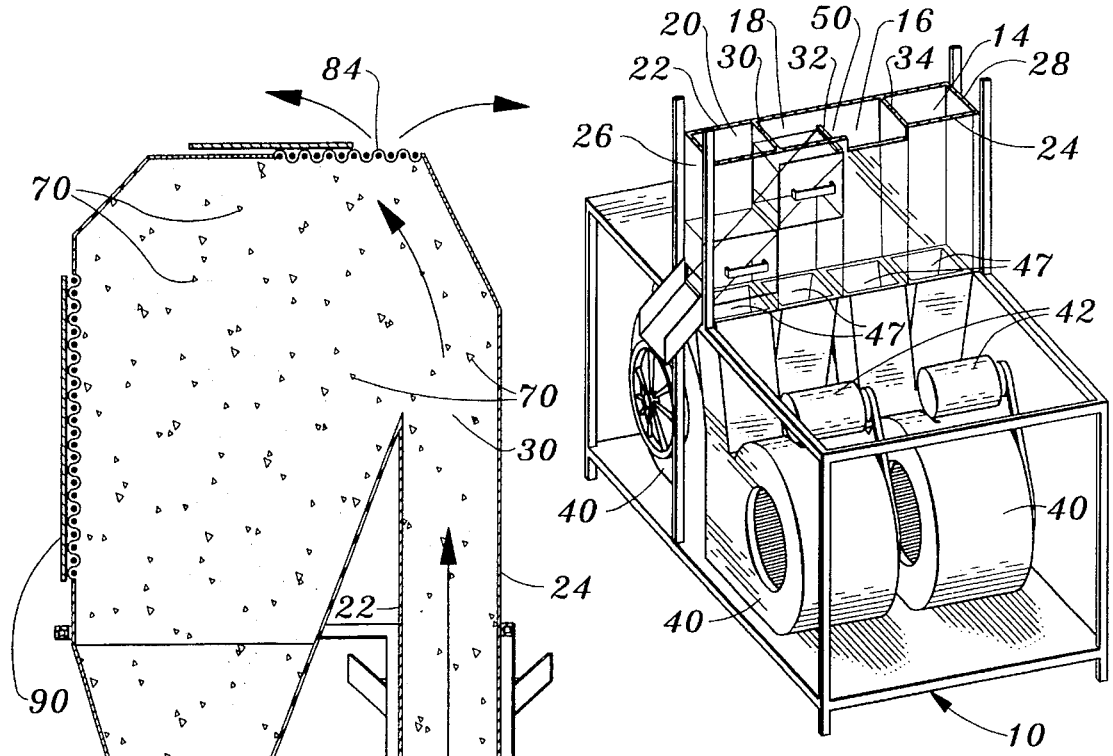
FIG. 4 is a cutaway perspective view illustrating blower fans and motors and related structure of the apparatus.
Figure 3:
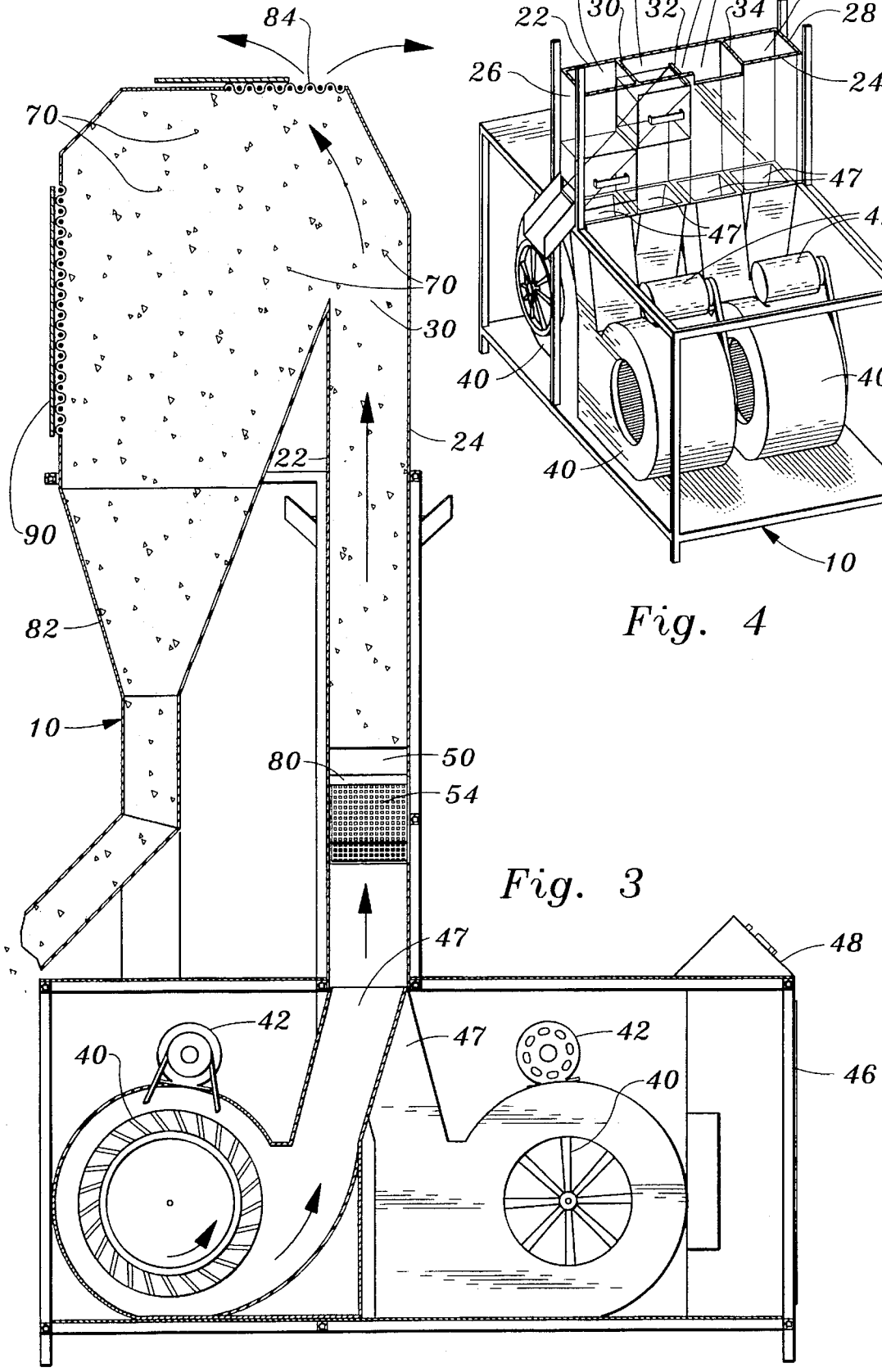
FIG. 3 is a cross-sectional view taken along the line 3—3 in FIG. 1.
Figure 5:
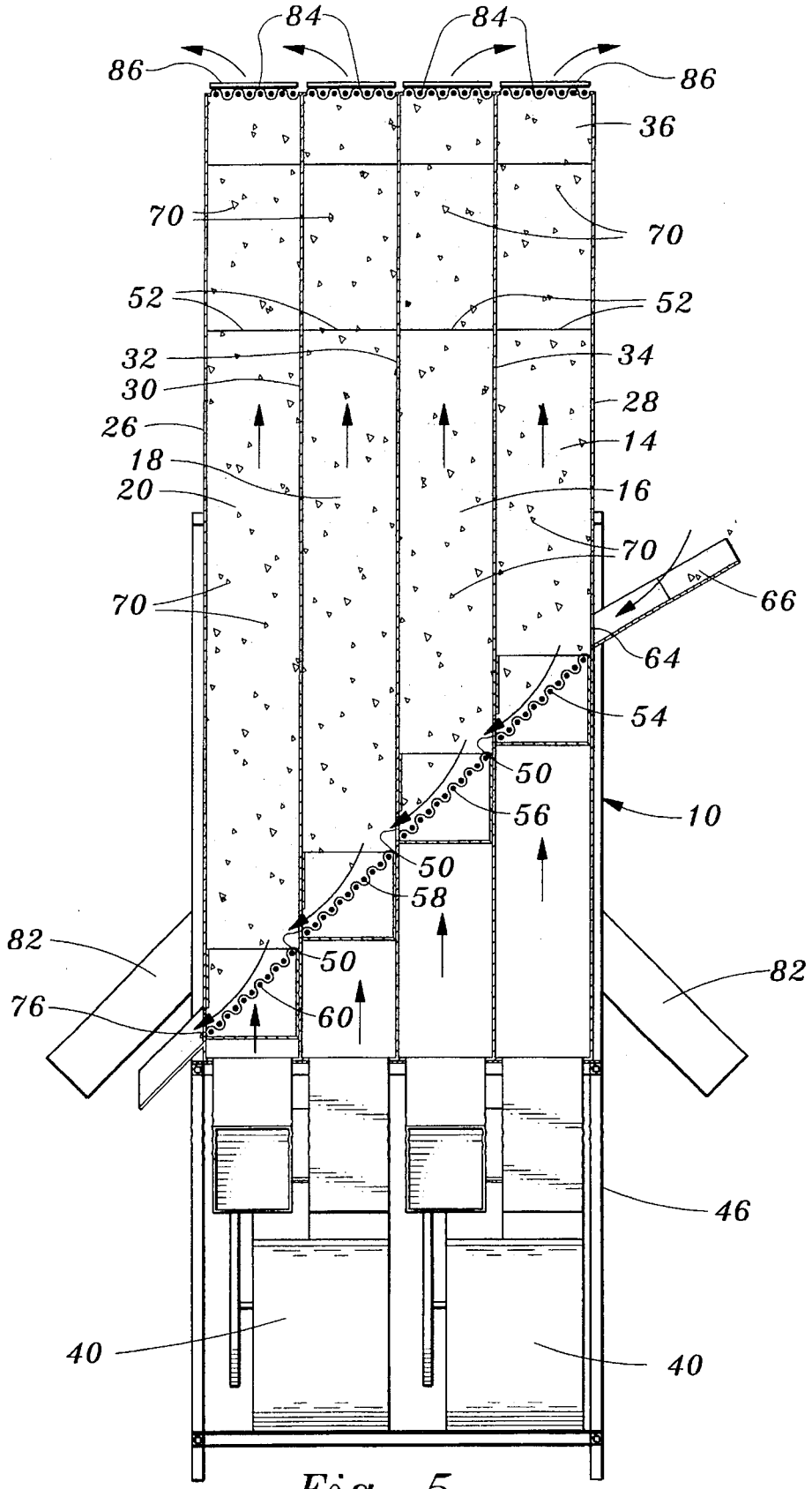
FIG. 5 is a cross-sectional view taken along the line 5—5 in FIG. 1.

Referring now to the drawings, apparatus constructed in accordance with the teachings of the present invention is designated by reference numeral 10. Apparatus 10 includes a housing 12 having chamber walls defining four separate, adjacent, vertically oriented chambers 14, 16, 18 and 20. More particularly, the chamber walls include chamber side walls 22, 24 and chamber end walls 26, 28. Additional chamber walls are in the form of chamber divider walls 30, 32 and 34 extending between chamber side walls 22, 24 parallel to chamber end walls 26, 28.

A top wall 36 is disposed above the chambers 14, 16, 18 and 20, the chamber end walls 26, 28 and chamber divider walls 30, 32, 34 proceeding upwardly to the top wall. It is preferred that the chamber walls of the apparatus be constructed of transparent material (as shown), such as clear plastic sheet material, so that the operator of the apparatus will be able to readily observe the interiors of the chambers. Any suitable expedient may be utilized to connect the chamber walls, such as adhesive or mechanical connectors (not shown).

Figure 8:
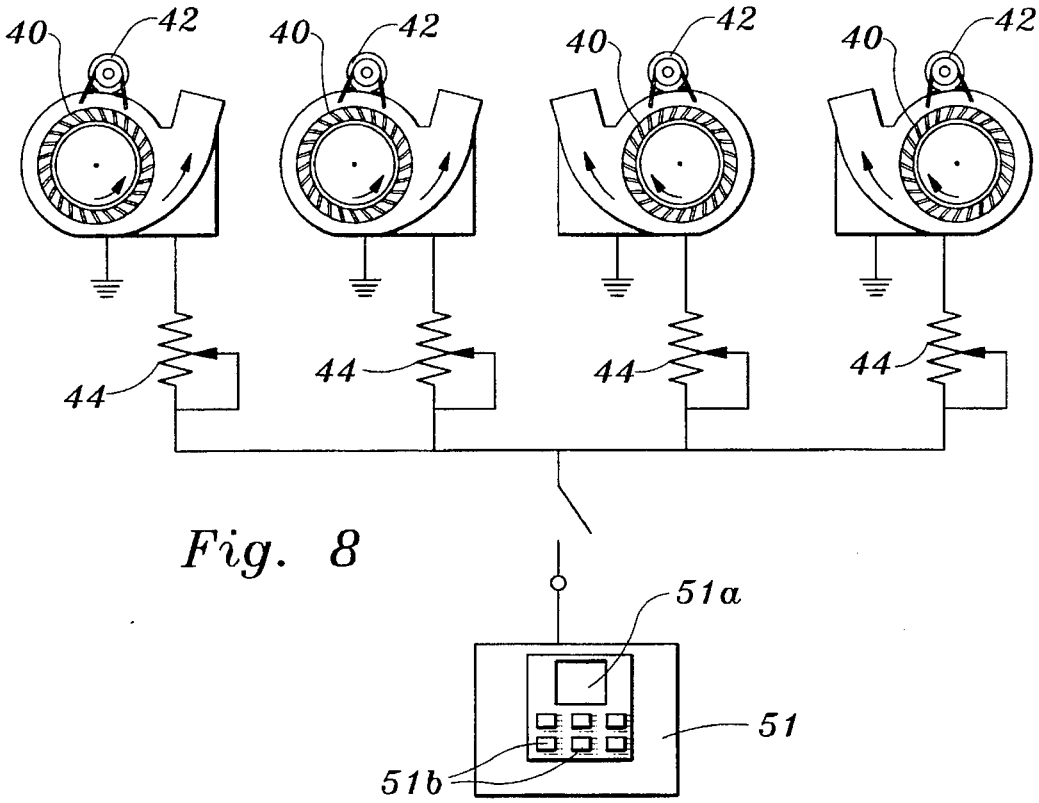
FIG. 8 is a diagrammatic view showing the motors, fans and controls of the apparatus.

Operatively associated with each chamber is a blower fan 40 rotated by a motor 42. As illustrated in schematic fashion in FIG. 8, a control such as a rheostat 44 is operatively associated with each of the motors 42 to control the speed of the motor and associated blower fan. In the arrangement illustrated, the fans and motors are disposed in housing base 46. A control panel 48 is preferably provided on the housing base to manually independently control the motor and fan speeds. Alternatively, a CPU, suitably programmed, could be used to control the motors. FIG. 8 illustrates a CPU control including digital display (monitor) 51 and keypads **51*b*** which may be placed in circuit with the motors. The CPU may be preprogrammed to set motor speeds in accordance with particular products, such as seed types, processed through the apparatus.

The fan air exit ports 47 lead to separate chambers and rotation of the blower fans 40 by motors 42 will cause air flows to move upwardly through the respective chambers from the bottom of the chambers. Controls 44 are utilized to vary the speed of such air flow and, as indicated above, this can be done with respect to each chamber on an independent, separate basis. If desired, suitable conventional monitoring and readout devices may be utilized to provide a visual indication to the operator of such factors as air flow velocities, speed of fan rotation, and so forth.

Chamber divider walls 30, 32 and 34 define passageways 50 between adjacent chambers. Passageways 50 are spaced downwardly from exit openings 52, the exit openings 52 in turn being located below top wall 36. In the illustrated embodiment, the exit openings 52 are defined by the upper end of side wall 22 and by the top wall 36.

Screens 54, 56, 58 and 60 are respectively located within chambers 14, 16, 18, and 20. The air flows within the chambers pass through the screens. The screens are tilted or canted, as shown, downwardly toward passageways 50 so that the screens, in effect, act as conveyers which will direct objects supported by the screens downwardly toward the passageways. The screens are disposed at different vertical levels to form a downward cascade of discrete objects during passage of the discrete objects between adjacent chambers through the passageways, the passageways 50 themselves, of course, also being disposed at different vertical levels as shown.

Figure 6:
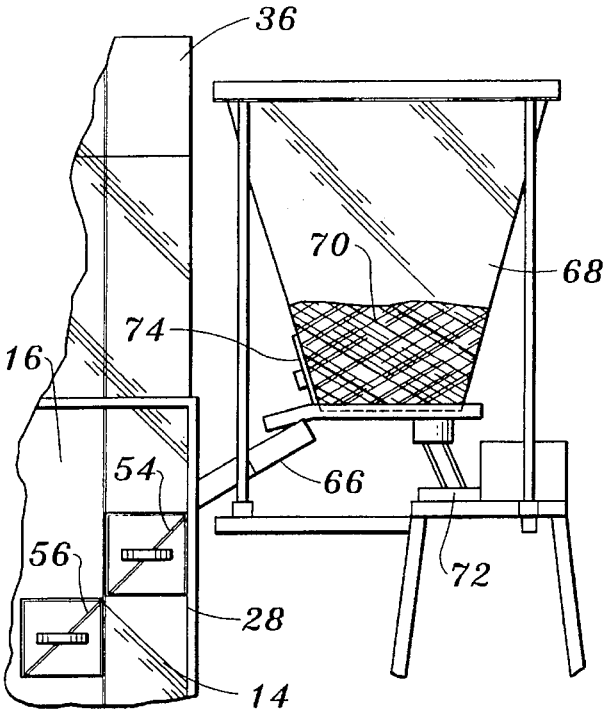
FIG. 6 is an elevational view showing selected structural components of the apparatus.

An entry opening 64 is formed in chamber end wall 28 at a level above screen 54. Adjacent to entry opening 64 is a feeder spout or chute 66 leading from a hopper 68. The interior of the hopper 68 contains a plurality of discrete objects, in this particular case a mixture of seeds 70 (shown in the hopper in FIG. 6 only). The hopper may, as shown, also be constructed of transparent materials such as plastic sheet material. A motor operated vibrator mechanism 72 of any suitable commercially available construction is operatively associated with the hopper 68 to facilitate movement of the seeds within the hopper interior down feeder spout or chute 66 under the influence of gravity. Suitable conventional controls in control box 73 may be utilized to control the action or speed of the vibrator mechanism. The spout 66 feeds the seeds 70 through entry opening 64 and thence into chamber 14. An adjustable closure 74 is operatively associated with the hopper 68 to control the rate at which the seeds are fed from the hopper so that flow rate of the seeds through the apparatus can be varied.

The blower fan and motor operatively associated with chamber 14 direct an air flow upwardly within such chamber and at least some of the seeds 70 entering chamber 14 will be entrained upwardly by the gaseous flow and caused to exit the exit opening 52 associated with chamber 14.

The number of the seeds 70 entering chamber 14 that are in fact caused to exit the exit opening 52 associated with chamber 14 will, of course, depend upon the physical characteristics of the seeds, in particular the weight, size, and aerodynamic properties of the seed. The seed which is too heavy, for example, or has a particularly aerodynamic shape, for example, will either stay on the screen 54 or return thereto under the influence of gravity, and work its way down the screen under the influence of gravity to passageway 50 separating chamber 14 from chamber 16.

An air flow also exists in chamber 16 and the seed entering same will be operated upon in the same manner as the seed in chamber 14. Thus, another apportionment of the seeds is made. The operation within chambers 18 and 20 is the same, with the seeds or other discrete objects which make it through all of the chambers passing out of an outlet 76 in chamber end wall 26.

Figure 7:
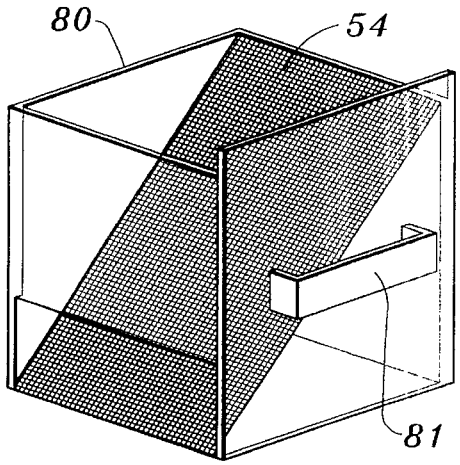
FIG. 7 is a perspective view showing details of a screen and related structure employed in the apparatus.

It will be appreciated that the transparent nature of the chamber walls allows the operator to "fine tune" the velocity of the air flows through the individual chambers to accomplish the desired results. This, as previously stated, can be accomplished by independently controlling the rotational speed of the blower fans. Alternatively, adjustable closures (not shown) between the blower fans and chambers may be utilized to control chamber air flow. The precise nature of the screens 54, 56, 58, 60 themselves also have some bearing on the velocity of the air flows in the individual chambers and different screens can be positioned in the chambers depending upon the nature of the discrete objects being divided and the apportioning thereof desired. In the arrangement illustrated, the screens are located in modules 80 which can be readily manually removed or inserted by the operator by handles 81. See FIG. 7 which depicts the module of which screen 54 is a part. The module walls are preferably transparent.

The seeds or other discrete objects exiting the various exit openings 52 will fall downwardly under the influence of gravity through chutes 82 for collection or further transport. Alternatively, the apparatus itself may incorporate bins for receiving the separated seeds or other discrete objects.

Vent openings 84 are located in the top wall 36 for venting at least portions of the upwardly directed gaseous flows into the ambient atmosphere. A slide 86 or other suitable vent adjustment means is provided for adjusting the size of each vent opening. Some influence can be exerted with respect to air flow velocities within the chambers by adjusting the effective sizes of the vent openings. To facilitate egress of entrainment air, vent screens 90 are formed in end walls 26.

The system disclosed herein has the ability to provide high efficiency cleaning and precise separation of a variety of agricultural and industrial products. When utilized for seed separation, the system's ability to separate less viable and immature seed improves the quality of the lot and therefore enhances seed germination. The ability of the user to control air flow and feed rate helps to achieve product purity as well.

I claim:

1. Apparatus for sorting a plurality of discrete objects and separating said discrete objects into separate groups based on one or more physical characteristics of said discrete objects, said apparatus comprising, in combination:

chamber defining means including chamber walls defining a plurality of separate vertically oriented chambers, said chamber walls having passageways between adjacent chambers of said plurality of chambers and exit openings spaced upwardly from said passageways communicating with said chambers;

gaseous flow inducing means operatively associated with said chamber defining means for creating upwardly directed gaseous flows in said plurality of chambers to entrain discrete objects located therein, cause upward movement of said discrete objects upwardly toward said exit openings, and exit of discrete objects from said chambers through said exit openings;

control means for separately and independently controlling the velocity of the upwardly directed gaseous flow in each chamber of said plurality of chambers; and conveying means for conveying discrete objects not exiting from a chamber through an exit opening due to entrainment by the gaseous flow therein through one of said passageways to an adjacent chamber and into the gaseous flow in said adjacent chambers; said gaseous flow inducing means comprising a plurality of motors and a plurality of fans, each of said fans being connected to a separate motor and rotatable thereby to create an upwardly directed gaseous flow in a single chamber of said plurality of chambers.

2. The apparatus according to claim 1 wherein said control means includes a control operatively associated with each of said fans for modifying the rotational speed thereof.

3. The apparatus according to claim 2 wherein the control operatively associated with each of said fans modifies the speed of the respective motor connected thereto.

4. The apparatus according to claim 1 wherein said conveying means includes a screen extending across each of said chambers for supporting discrete objects therein and allowing the passage of upwardly directed gaseous flow therethrough, each said screen being disposed at an angle to direct discrete objects supported thereby toward a passageway between adjacent chambers under the influence of gravity.

5. The apparatus according to claim 4 wherein said screens are selectively independently removable from said passageways to allow replacement of said screens.

6. The apparatus according to claim 4 wherein said screens are disposed at different vertical levels to form a downward cascade of discrete objects during passage of said discrete objects between adjacent chambers through said passageways.

7. The apparatus according to claim 1 additionally comprising discrete object supply means for supplying discrete objects to said first chamber.

8. The apparatus according to claim 7 wherein said discrete object supply means comprises a hopper elevated relative to said first chamber and having a hopper outlet for supplying discrete objects to said first chamber.

9. The apparatus according to claim 8 additionally comprising means for vibrating said hopper.

10. A method of sorting a plurality of discrete objects and separating said discrete objects into separate groups based on one or more physical characteristics of said discrete objects, said method comprising the steps of:

introducing discrete objects into a first chamber having a first passageway and a first exit opening spaced upwardly from said first passageway:

directing a first upwardly directed gaseous flow through a screen into said first chamber;

entraining discrete objects in said first chamber in said first upwardly directed gaseous flow;

passing at least some of said first gaseous flow through said first exit opening along with discrete objects entrained thereby;

moving through said first passageway the discrete objects which did not pass through said first exit opening into a second chamber having a second passageway and a second exit opening spaced upwardly from said second passageway;

directing a second upwardly directed gaseous flow through a screen into said second chamber;

entraining discrete objects which moved through said first passageway into said second chamber in said second upwardly directed gaseous flow;

passing at least some of said second gaseous flow through said second exit opening along with discrete objects entrained thereby;

moving through said second passageway the discrete objects which did not pass through said second exit opening; and conveying discrete objects on said screens to said passageways.

11. The method according to claim 10 including the additional step of independently controlling the velocity of the gaseous flows in said first and second chambers.

12. The method according to claim 10 wherein said screens are tilted and wherein the discrete objects are conveyed on said screens at least partially by gravity.

13. Apparatus for sorting a plurality of discrete objects and separating said discrete objects into separate groups based on one or more physical characteristics of said discrete objects, said apparatus comprising, in combination:

chamber defining means including chamber walls defining a plurality of separate vertically oriented chambers, said chamber walls having passageways between adjacent chambers of said plurality of chambers and exit openings spaced upwardly from said passageways communicating with said chambers;

gaseous flow inducing means operatively associated with said chamber defining means for creating upwardly directed gaseous flows in said plurality of chambers to entrain discrete objects located therein, cause upward movement of said discrete objects upwardly toward said exit openings, and exit of discrete objects from said chambers through said exit openings;

control means for separately and independently controlling the velocity of the upwardly directed gaseous flow in each chamber of said plurality of chambers;

conveying means for conveying discrete objects not exiting from a chamber through an exit opening due to entrainment by the gaseous flow therein through one of said passageways to an adjacent chamber and into the gaseous flow in said adjacent chamber; and a top wall disposed above each of said chambers and above said exit openings engageable by the upwardly directed gaseous flows in said chambers to direct said upwardly directed gaseous flows and discrete objects entrained thereby through said exit openings, at least one vent opening located in said top wall for venting at least portions of said upwardly directed gaseous flows into the ambient atmosphere.

14. The apparatus according to claim 13 additionally comprising vent adjustment means for adjusting the size of said vent opening.

15. Apparatus for sorting a plurality of discrete objects and separating said discrete objects into separate groups based on one or more physical characteristics of said discrete objects, said apparatus comprising, in combination:

chamber defining means including chamber walls defining a plurality of separate vertically oriented chambers, said chamber walls having passageways between adjacent chambers of said plurality of-chambers and exit openings spaced Upwardly from said passageways communicating with said chambers;

gaseous flow inducing means operatively associated with said chamber defining means for creating upwardly directed gaseous flows in said plurality of chambers to entrain discrete objects located therein, cause upward movement of said discrete objects upwardly toward said exit openings, and exit of discrete objects from said chambers through said exit openings;

control means for separately and independently controlling the velocity of the upwardly directed gaseous flow in each chamber of said plurality of chambers; and conveying means for conveying discrete objects not exiting from a chamber through an exit opening due to entrainment by the gaseous flow therein through one of said passageways to an adjacent chamber and into the gaseous flow in said adjacent chamber, at least some of said chamber walls being transparent for allowing observation of movement of said discrete objects in said chambers.

16. Apparatus for sorting a plurality of discrete objects and separating said discrete objects into separate groups based on one or more physical characteristics of said discrete objects, said apparatus comprising, in combination:

chamber defining means including chamber walls defining a plurality of separate vertically oriented chambers, said chamber walls having passageways between adjacent chambers of said plurality of chambers and exit openings spaced upwardly from said passageways communicating with said chambers;

gaseous flow inducing means operatively associated with said chamber defining means for creating upwardly directed gaseous flows in said plurality of chambers to entrain discrete objects located therein, cause upward movement of said discrete objects upwardly toward said exit openings, and exit of discrete objects from said chambers through said exit openings;

control means for separately and independently controlling the velocity of the upwardly directed gaseous flow in each chamber of said plurality of chambers;

conveying means for conveying discrete objects not exiting from a chamber through an exit opening due to entrainment by the gaseous flow therein through a passageway to an adjacent chamber and into the gaseous flow in said adjacent chamber; and discrete object discharge chutes for receiving and discharging discrete objects after passage thereof through said exit openings.

* * * * *